US007488041B2

(12) United States Patent
Pokrishevsky et al.

(10) Patent No.: US 7,488,041 B2
(45) Date of Patent: Feb. 10, 2009

(54) LEGLESS CHAIR

(75) Inventors: Yury Pokrishevsky, Santa Monica, CA (US); Michael Feldman, Los Angeles, CA (US); Joey C. Huang, Temple City, CA (US)

(73) Assignee: Pyramat LLC, Cerritos, CA (US)

( * ) Notice: Subject to any disclaimer, the term of this patent is extended or adjusted under 35 U.S.C. 154(b) by 0 days.

(21) Appl. No.: 11/723,486

(22) Filed: Mar. 20, 2007

(65) Prior Publication Data

US 2008/0067847 A1 Mar. 20, 2008

(30) Foreign Application Priority Data

Sep. 15, 2006 (CN) ..... 2006 2 0120941 U

(51) Int. Cl.
*A47C 4/00* (2006.01)
*A47C 7/72* (2006.01)
*A47C 7/02* (2006.01)
*A47C 15/00* (2006.01)

(52) U.S. Cl. ..... 297/352; 297/17; 297/183.1; 297/183.5; 297/217.4; 297/230.1; 297/230.11; 297/230.12; 297/230.13; 297/253; 297/378.1

(58) Field of Classification Search ..... 297/17, 297/183.1, 183.5, 217.4, 230, 252, 353, 352, 297/378.1, 230.1, 230.11, 230.12, 230.13, 297/253
See application file for complete search history.

(56) References Cited

U.S. PATENT DOCUMENTS 1,444,014 A * 2/1923 Truesdell ..... 297/253
1,555,526 A * 9/1925 Smith ..... 297/378.1
1,882,485 A * 10/1932 Clements ..... 297/253
1,954,376 A * 4/1934 Brueckl ..... 297/253
1,999,560 A * 4/1935 Brueckl ..... 297/253
2,007,075 A * 7/1935 Clements ..... 297/253
2,119,023 A * 5/1938 Pickard ..... 297/253
2,260,352 A * 10/1941 Trapani ..... 297/230.11 X
2,563,922 A * 8/1951 Collins ..... 297/253 X
2,663,359 A * 12/1953 Wood ..... 297/253
2,716,443 A * 8/1955 Laughlin ..... 297/230.11
2,756,808 A * 7/1956 Eichorst ..... 297/230.11
2,833,341 A * 5/1958 Bornstein ..... 297/253 X
3,323,151 A * 6/1967 Lerman ..... 297/183.5 X
3,480,323 A * 11/1969 Propus ..... 297/253
3,720,965 A * 3/1973 Wright ..... 297/352
4,047,757 A * 9/1977 Eames et al. ..... 297/253 X
4,208,070 A * 6/1980 Geschwender ..... 297/118
4,410,214 A * 10/1983 Geschwender ..... 297/118
5,803,542 A * 9/1998 Insausti ..... 297/230.12 X
5,884,967 A * 3/1999 Gasper ..... 297/253 X
6,532,962 B1 * 3/2003 Walker et al. ..... 128/845

(Continued)

FOREIGN PATENT DOCUMENTS

EP 251130 A2 * 1/1988 ..... 297/352

*Primary Examiner*—Rodney B. White
(74) *Attorney, Agent, or Firm*—Browdy and Neimark, P.L.L.C.

(57) ABSTRACT

A legless chair includes a seat, a seatback having its bottom side connected to the seat, and a flexible member backwardly extending from a rear side of the seat. When the user sitting on the seat forces his/her back against the seatback to tilt the legless chair backwards, the flexible member is bendable to impart a damping force against the backwardly tilting motion of the legless chair so as to prevent the backward falling of the legless chair.

21 Claims, 3 Drawing Sheets

U.S. PATENT DOCUMENTS 6,860,557 B2 * 3/2005 Jonasson ..... 297/253
6,913,312 B2 * 7/2005 Clary et al. ..... 297/118
7,313,836 B1 * 1/2008 Swezey et al. ..... 297/230.1 X
2003/0071505 A1 * 4/2003 Ferrell, Jr. ..... 297/352
2006/0082198 A1 * 4/2006 Mafrice et al. ..... 297/217.4

* cited by examiner

LEGLESS CHAIR

BACKGROUND OF THE INVENTION

1. Field of the Invention

The present invention relates generally to legless chairs and more particularly, to a legless chair having a seat and a seatback, which can prevent backward falling when the seatback is forced to incline backwardly.

2. Description of the Related Art

A conventional legless chair generally comprises a seat and a seatback. The seat is to be directly placed on the floor. The seatback has its bottom side connected to the rear side of the seat so that when the user is sitting with his/her hip and thighs on the seat, the user's back can be supported on the seatback comfortably. However, when the user forces his/her back against the seatback with an exceeding force accidentally, the legless chair may fall down backwardly to the floor, and the back side of the user's head may hit the floor, resulting in a potential injury.

SUMMARY OF THE INVENTION

The present invention has been accomplished under the circumstances in view. It is one objective of the present invention to provide a legless chair, which can prevent backward falling to the floor when the seatback of the legless chair is forced to incline backwardly.

To achieve this objective of the present invention, the legless chair provided by the present invention comprises a seat, a seatback having its bottom side connected to the seat, and a flexible member backwardly extending from a rear side of the seat. The flexible member is bendable when the seatback is forced to incline backwardly, thereby providing a damping force against further inclining movement of the backseat so as to prevent the backward falling of the legless chair.

In a preferred embodiment of the present invention, the seat comprises a U-shaped seat frame with two arms, a reinforced crossbar connected between the two arms, and a seat cushion encapsulating the U-shaped seat frame and the crossbar. The flexible member is a flexible plate connected to and extending backwardly from rear sides of the two arms of the U-shaped frame of the seat.

In another preferred embodiment of the present invention, the flexible member comprises two flexible strips respectively connected to and extending backwardly from a rear side of the seat cushion of the seat.

It is another aspect of the present invention to provide a legless chair, which is equipped with a music-playing device including a transmission interface for connection to a music source, and speakers electrically connected to the transmission interface.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
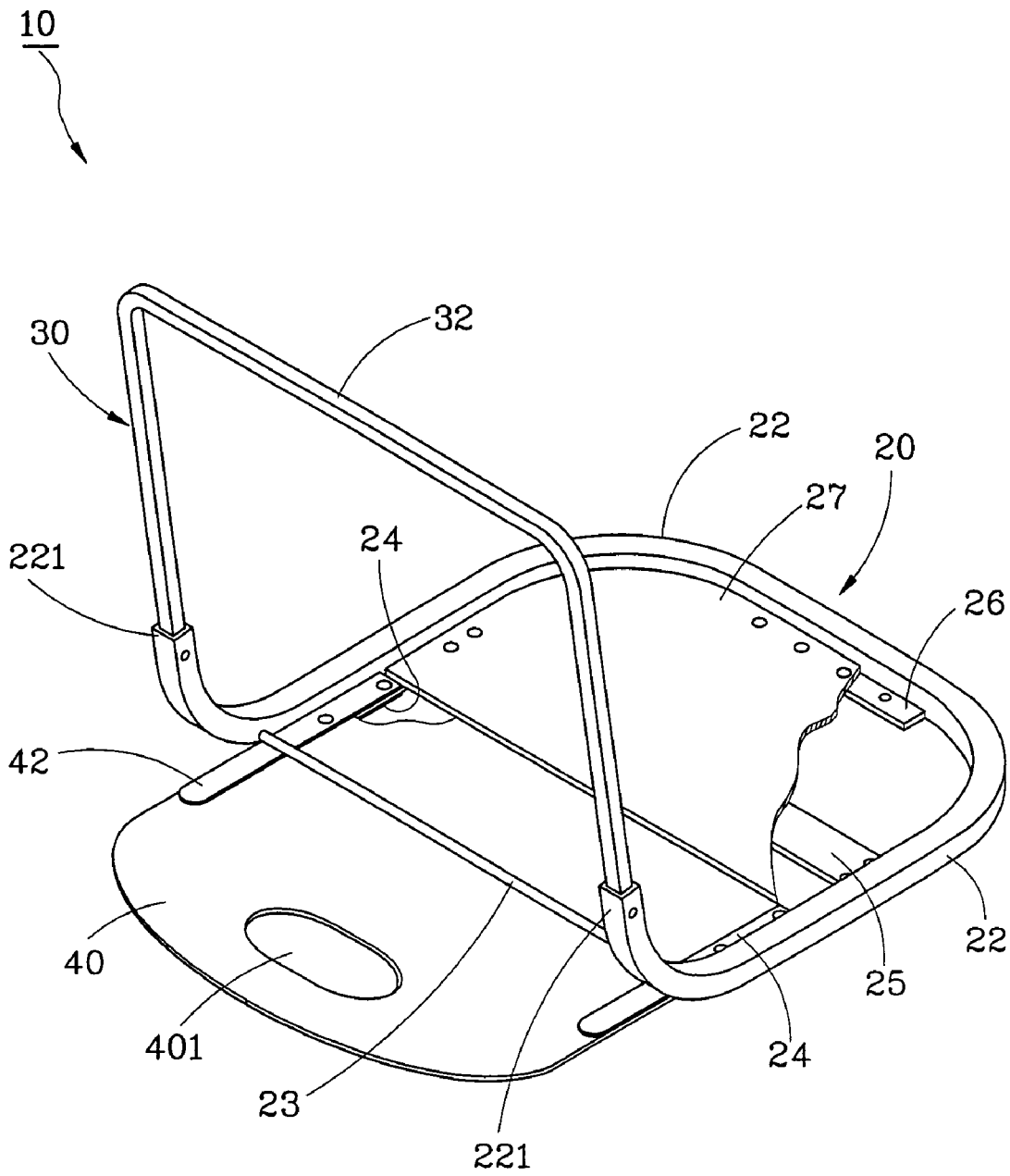
FIG. 1 is a perspective view of a frame structure of a legless chair in accordance with a first preferred embodiment of the present invention.
Figure 2:
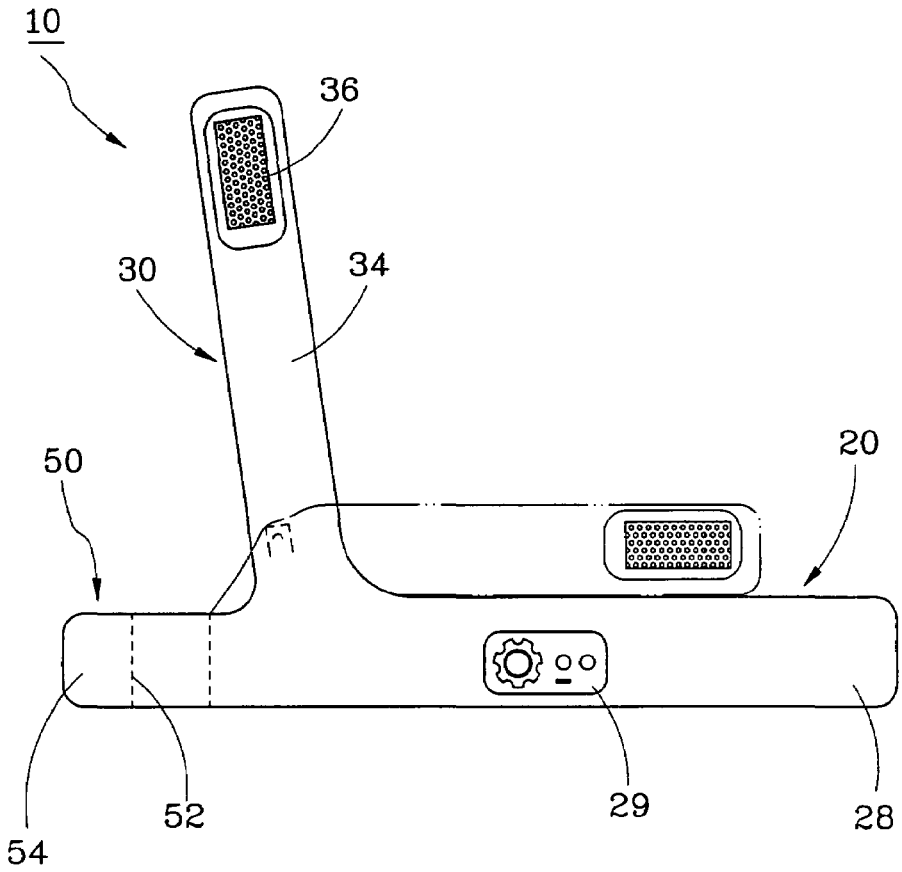
FIG. 2 is a side plane view of the legless chair in accordance with a first preferred embodiment of the present invention.
Figure 3:
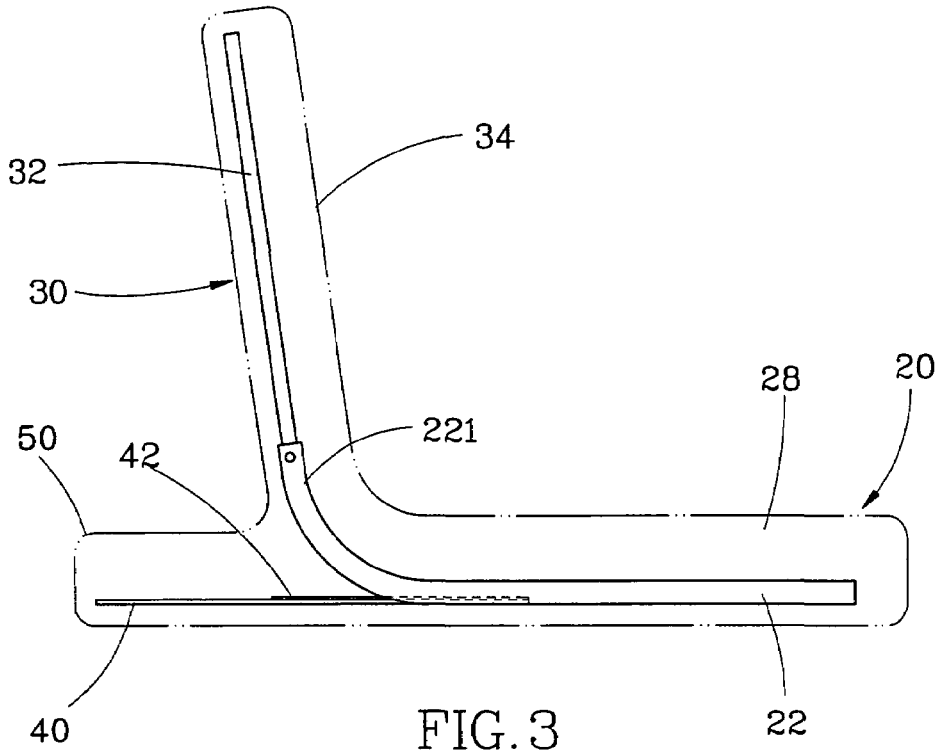
FIG. 3 is a schematic view showing that the legless chair is in a normal posture where no external force is applied on the seatback of the legless chair.

As shown in FIGS. 1-3, a legless chair 10 in accordance with a first preferred embodiment of the present invention comprises a seat 20, a seatback 30, and a flexible member 40, two spring pieces 42, and a rear cushion 50.

The seat 20 includes a U-shaped seat frame 22, a crossbar 23, two locating plates 24, two supporting plates 25 and 26, a lining sheet member 27, a seat cushion 28, and a transmission interface 29. The U-shaped seat frame 22 is made of aluminum tube by bending process. The U-shaped frame 22 has two parallel extending arms, each of which has an upwardly curved end portion 221. The crossbar 23 is transversely connected between the two arms of the U-shaped seat frame 22 near the upwardly curved end portions 221. The two locating plates 24 are bilaterally respectively affixed to inner lateral sides of the two arms of the U-shaped seat frame 22 near the rear side of the U-shaped seat frame 22. The two supporting plates 25 and 26 are affixed to the U-shaped seat frame 22 in front of the locating plates 24. The lining sheet member 27 is a plastic sheet member mounted on the two supporting plates 25 and 26. The seat cushion 28 encapsulates the U-shaped seat frame 22, the crossbar 23, the locating plates 24, the supporting plates 25 and 26, and the lining sheet member 27. The transmission interface 29 is mounted at one lateral side of the seat cushion 28 for the connection of a music source through a signal transmission line (not shown).

The seatback 30 is adapted to support the back of the user sitting on the seat 20, having a U-shaped seatback frame 32, a seatback cushion 34, and two speakers 36. The U-shaped seatback frame 32 is made of aluminum tube, having two arms with its two distal ends pivotally connected to the upwardly curved end portions 221 of the U-shaped seat frame 22. The seatback cushion 34 is integrally formed with the seat cushion 28 and encapsulates the U-shaped seatback frame 32. The two speakers 36 are installed in the two opposite lateral sides of the seatback cushion 34 and electrically connected to the transmission interface 29 for output of voice signal received by the transmission interface 29.

The flexible member 40, which is embodied as a flexible plastic plate in this preferred embodiment for illustrative purpose, is affixed to the locating plates 24 of the seat 20 by screws and extends backwardly and horizontally from the locating plates 24 for a predetermined length. The flexible member 40 is provided with an oval through hole 401 at a rear portion thereof.

The two spring pieces 42 are respectively connected with the locating plates 24 of the seat 20 by screws and spacedly attached on two lateral sides of the top surface of the flexible member 40. According to the present preferred embodiment, the spring pieces 42 are made out of spring steel, having a strong resilient characteristic.

The rear cushion 50 is integrally formed with the seat cushion 28 and encapsulates the flexible member 40. The rear cushion 50 has an oval through hole 52 corresponding to the through hole 401 of the flexible member 40 such that the rear part of the rear cushion 50 constitutes a handle 54 by which the user can carry the legless chair 10 with his/her hand conveniently.

Figure 4:
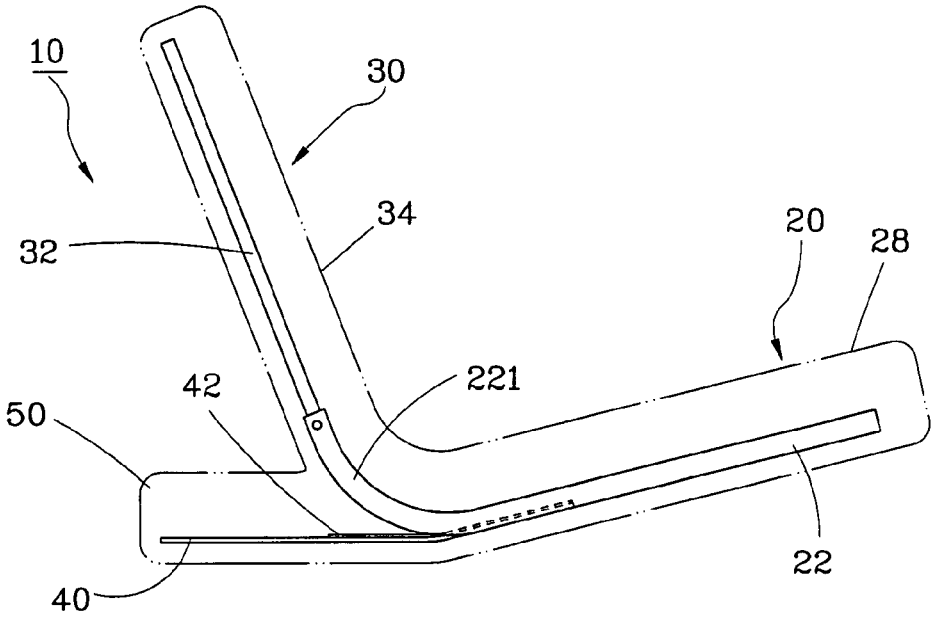
FIG. 4 is similar to FIG. 3, but showing that the seatback and the seat of the legless chair are forced to incline backwardly and the flexible member is bent.

When the user sitting on the seat 20 shifts the center of gravity of the body toward the rear side and forces the back of the body against the seatback 30, the seat 20 and the seatback 30 are tilted backwards to bend the flexible member 40 and the spring pieces 42 as shown FIG. 4. At this time, the rebound force of the flexible member 40 and the spring pieces 42 works as a damping against the backwardly tilting motion of the seat 20 and the seatback 30 to limit the backwardly tilting angle of the seat 20 and the seatback 30 to prevent the backward falling of the legless chair 10 so as to avoid the rear part of the user's head from touching the floor, thereby ensuring a safety use of the legless chair 10. Further, the user can fold the seatback 30 forwards and closely attach the seatback 30 to the top side of the seat 20 (see the imaginary line in FIG. 2), thereby reducing the size of the legless chair 10 to save storage space.

Further, the crossbar 23 reinforces the structural strength of the legless chair 10, supporting the U-shaped seat frame 22 and the U-shaped seatback frame 32 against deformation. However, the crossbar 23 can be eliminated if desired. The two spring pieces 42 are used to give a supplementary damping force to the seat 20 and the seatback 30 when the user tilts the legless chair 10 backwards. Therefore, the spring pieces 42 can be eliminated if the flexible member 40 can provide sufficient damping force to the seat 20 and the seatback 30 when the user tilts the legless chair 10 backwards.

Figure 5:
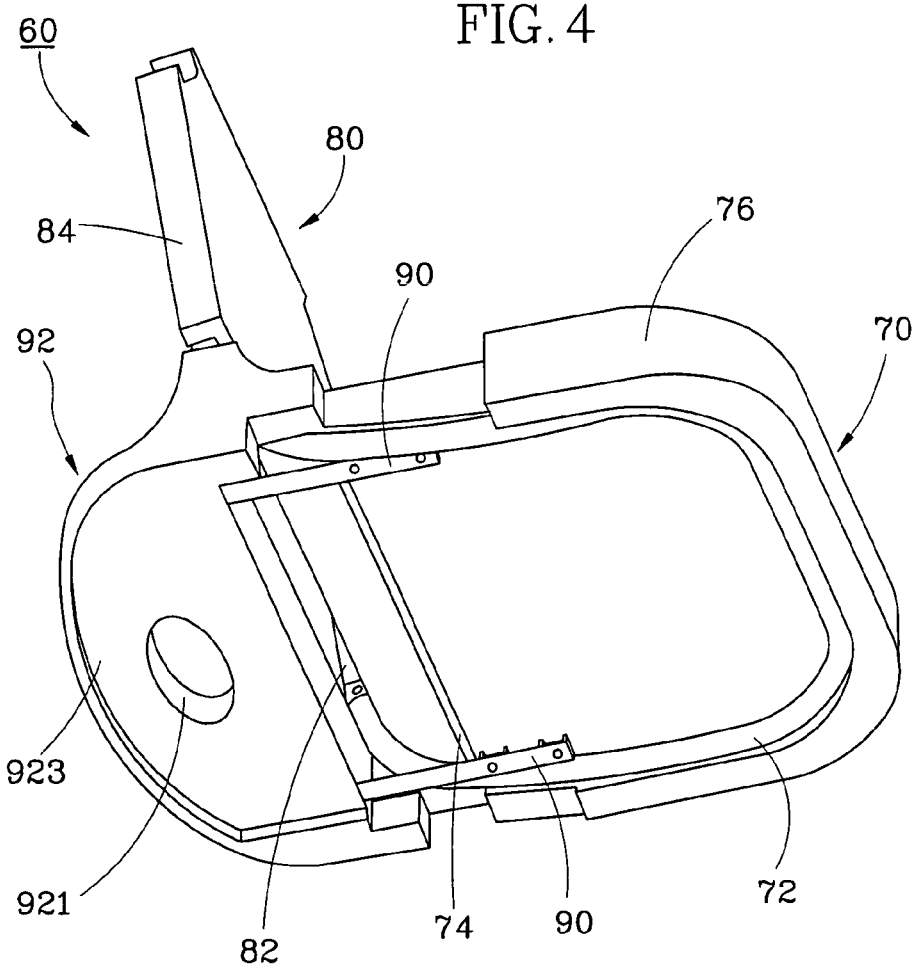
FIG. 5 is a perspective bottom view of a legless chair in accordance with a second preferred embodiment of the present invention.

FIG. 5 shows a legless chair 60 in accordance with a second preferred embodiment of the present invention. Similar to the aforesaid first embodiment, the legless chair 60 comprises a U-shaped seat frame 72, a crossbar 74 connected between the two arms of the seat frame 72, and a U-shaped seatback frame 82 having its bottom side connected to the rear side of the seat frame 72. In this preferred embodiment, the flexible member is embodied as two flexible strips 90 made of spring steel. The two flexible strips 90 are connected with the front ends thereof to the rear side of the seat cushion 76 of the seat 70. The seat cushion 76 of the seat 70, the seatback cushion 84 of the seatback 80 and the rear cushion 92 are made independently and respectively encapsulate the U-shaped seat frame 72, the U-shaped seatback frame 82 and the two flexible strips 90. The rear cushion 92 has an oval through hole 921, defining a handle 923. Although the legless chair 60 of the second preferred embodiment eliminates the aforesaid locating plates 24, supporting plates 25 and 26, lining sheet member 27, transmission interface 29, speakers 36 and spring pieces 42, which are shown in the first preferred embodiment, this second embodiment achieves the same function as the aforesaid first embodiment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A legless chair comprising:

a seat;

a seatback connected to the seat; and a flexible member backwardly extending from a rear side of the seat, which is bendable when the seatback is forced to incline backwardly;

wherein the seat comprises a U-shaped seat frame with two arms, and the flexible member is connected to and extends backwardly from the two arms of the U-shaped seat frame of the seat.

2. The legless chair as claimed in claim 1, wherein the flexible member is a flexible plate connected to the rear side of the seat and backwardly and horizontally extending from the rear side of the seat.

3. The legless chair as claimed in claim 1, wherein the flexible member comprises two flexible strips spacedly connected to the rear side of the seat and backwardly and horizontally extending from the rear side of the seat.

4. The legless chair as claimed in claim 1, wherein the seatback is pivotally connected to the seat.

5. The legless chair as claimed in claim 1, further comprising a spring piece backwardly extending from the rear side of the seat and attached on the flexible member.

6. The legless chair as claimed in claim 1, wherein the seatback is equipped with at least one speaker.

7. The legless chair as claimed in claim 1, wherein the two arms of the U-shaped seat frame of the seat each have an upwardly curved end portion; the seatback comprises a U-shaped seatback frame with two arms pivotally connected to the two upwardly curved end portions of the two arms of the U-shaped seat frame of the seat.

8. The legless chair as claimed in claim 7, wherein the seat further comprises a reinforced crossbar transversely connected between the two arms of the U-shaped seat frame.

9. The legless chair as claimed in claim 1, further comprising two spring pieces respectively connected to and backwardly extending from the two arms of the U-shaped seat frame of the seat and attached on the flexible member.

10. The legless chair as claimed in claim 1, wherein the seat comprises a seat cushion; the flexible member comprises two flexible strips spacedly connected to and horizontally extending from a rear side of the seat cushion of the seat.

11. The legless chair as claimed in claim 1, further comprising a rear cushion encapsulating the flexible member.

12. The legless chair as claimed in claim 11, wherein the rear cushion has a through hole such that a handle is defined at a rear side of the rear cushion.

13. A legless chair comprising:

a seat;

a seatback connected to the seat; and a flexible member backwardly extending from a rear side of the seat, which is bendable when the seatback is forced to incline backwardly; and a spring piece backwardly extending from the rear side of the seat and attached on the flexible member.

14. The legless chair as claimed in claim 13, wherein the seat comprises a U-shaped seat frame with two arms; the flexible member is connected to and extends backwardly from the two arms of the U-shaped seat frame of the seat.

15. The legless chair as claimed in claim 13, wherein the flexible member is a flexible plate connected to the rear side of the seat and backwardly and horizontally extending from the rear side of the seat.

16. The legless chair as claimed in claim 13, wherein the flexible member comprises two flexible strips spacedly connected to the rear side of the seat and backwardly and horizontally extending from the rear side of the seat.

17. The legless chair as claimed in claim 13, wherein the seatback is pivotally connected to the seat.

18. The legless chair as claimed in claim 13, wherein the seatback is equipped with at least one speaker.

19. The legless chair as claimed in claim 13, wherein the seat comprises a seat cushion; the flexible member comprises two flexible strips spacedly connected to and horizontally extending from a rear side of the seat cushion of the seat.

20. The legless chair as claimed in claim 13, further comprising a rear cushion encapsulating the flexible member.

21. The legless chair as claimed in claim 13, wherein the rear cushion has a through hole such that a handle is defined at a rear side of the rear cushion.

* * * * *